US011167164B2

(12) United States Patent
Landis

(10) Patent No.: US 11,167,164 B2
(45) Date of Patent: Nov. 9, 2021

(54) CONNECTING STRAPS FOR SPORTS ACTIVITIES

(71) Applicant: Eric Michael Landis, Grand Junction, CO (US)

(72) Inventor: Eric Michael Landis, Grand Junction, CO (US)

( * ) Notice: Subject to any disclaimer, the term of this patent is extended or adjusted under 35 U.S.C. 154(b) by 0 days.

(21) Appl. No.: 17/318,548

(22) Filed: May 12, 2021

(65) Prior Publication Data

US 2021/0260427 A1 Aug. 26, 2021

Related U.S. Application Data

(63) Continuation of application No. 16/946,058, filed on Jun. 4, 2020.

(60) Provisional application No. 62/864,757, filed on Jun. 21, 2019.

(51) Int. Cl.

*A63B 21/055* (2006.01)
*A63B 21/28* (2006.01)
*A63B 21/04* (2006.01)

(52) U.S. Cl.

CPC ..... *A63B 21/0555* (2013.01); *A63B 21/0557* (2013.01); *A63B 21/285* (2013.01); *A63B 21/0407* (2013.01)

(58) Field of Classification Search

CPC . A63B 21/0555; A63B 21/0557; A63B 21/04; A63B 21/0407; A63B 21/0421; A63B 21/0428; A63B 21/4035; A63B 21/0442; A63B 21/055; A63B 21/0552; A63B 21/28; A63B 21/285; A63B 21/4025; A63B 5/04

See application file for complete search history.

(56) References Cited

U.S. PATENT DOCUMENTS 5,205,803 A * 4/1993 Zemitis ..... A63B 21/0552 482/121
5,518,481 A * 5/1996 Darkwah ..... A63B 21/0004 482/126
7,794,374 B1 * 9/2010 Park ..... A63B 21/0552 482/122
7,798,712 B2 * 9/2010 Russick ..... B65F 1/0006 383/24
10,384,094 B1 * 8/2019 Newman ..... A63B 71/0054

(Continued)

FOREIGN PATENT DOCUMENTS

WO 2011081534 A1 7/2011

OTHER PUBLICATIONS

Nylon Material: Website: http://matweb.com/search/DataSheet.aspx?MatGUID=8d78f3cfcb6f49d595896ce6ce6a2ef1&ckck=1 (Year: 2017).*

*Primary Examiner* — Megan Anderson
(74) *Attorney, Agent, or Firm* — Leber IP Law; Sarah Gates

(57) ABSTRACT

Connecting straps, for use for example in sports activities, include (a) a sleeve of webbing having a first end and a second end and having a loop at each end, each loop having a base and a free end, (b) disposed within the sleeve of webbing, a band of elastic material extending in a continuous loop, and (c) an attachment strap, adjacent each loop, configured to secure a portion of the band to the webbing at the base of each loop. In some cases, the band has a solid, polygonal cross-sectional shape.

19 Claims, 5 Drawing Sheets

(56) References Cited

U.S. PATENT DOCUMENTS

| | | | | |
|---|---|---|---|---|
| 2007/0232468 | A1* | 10/2007 | Levy | A63B 21/028 482/121 |
| 2012/0202659 | A1* | 8/2012 | Wroclawsky | A63B 23/04 482/125 |
| 2013/0067697 | A1* | 3/2013 | Huang | A63B 21/0555 24/301 |

* cited by examiner

CONNECTING STRAPS FOR SPORTS ACTIVITIES

CROSS-REFERENCE TO RELATED APPLICATIONS

This application is a continuation of and claims priority to co-pending U.S. application Ser. No. 16/946,058 filed on Jun. 4, 2020, which claims priority to U.S. Provisional Application Ser. No. 62/864,757 filed on Jun. 21, 2019, the entire disclosures of which are incorporated herein by reference.

BACKGROUND

When two participants of unequal strength or ability, for example an adult and child, bicycle or ski together it can be difficult or even impossible for them to both maintain the same speed. In some cases, such as bicycling uphill, the less proficient participant will fall behind, while in other cases, such as downhill skiing, the less proficient participant may end up unintentionally going too fast and potentially losing control. Thus, for safety and enjoyability of the activity it can be desirable to provide a way to join the two participants together.

However, it is important from a safety standpoint that any type of connecting strap be strong enough to avoid failure due to the forces that will be encountered, not dangle onto the ground or into a bicyclist's wheel, and not jerk either user during use.

SUMMARY

The present disclosure pertains to connecting straps, and in particular to straps for connecting two persons taking part in a sports activity, or in some cases a person and an object to be towed.

In one aspect, the disclosure features a connecting strap that includes (a) a sleeve of webbing having a first end and a second end and having a loop at each end, each loop having a base and a free end, (b) disposed within the sleeve of webbing, a band of elastic material extending in a continuous loop, and (c) an attachment strap, adjacent each loop, configured to secure a portion of the band to the webbing at the base of each loop.

Some implementations of the connecting strap include one or more of the following features.

The band may have a solid, polygonal cross-sectional shape. The cross-sectional shape of the band may be, for example, square or rectangular.

The attachment strap may be formed of polyester or nylon. In some cases, the attachment strap will bunch up when tension is released from the elastic band causing the elastic band to draw it together. The attachment strap has two ends, and preferably is looped through the band and secured by stitching both ends of the attachment strap to the webbing. In some cases, each loop is formed by doubling a free end of the sleeve back and securing the free end in place with the same stitching that secures the ends of the attachment strap to the webbing, thereby forming the base of the loop with one continuous piece of webbing.

In some implementations, the webbing sleeve is configured for a maximum elongation of 4:1 and the band is configured for a maximum elongation of 7:1. The band may be formed of a natural rubber or thermoplastic elastomer, for example, of dipped natural latex. In some cases, the band is configured to pull no more than 18 pounds of weight, for example, no more than 15 pounds of weight, before the webbing sleeve engages and takes the load. The webbing sleeve is configured to prevent the rubber from being over stretched as well as protecting the rubber from UV damage. The band may, for example, have a length of from about 40 to 50 inches when in a relaxed (unstretched) condition. At full extension the length of the band can reach about 160 to 200 inches. The webbing sleeve may be formed of polypropylene or nylon.

In another aspect, the present disclosure features methods of utilizing the connecting straps disclosed herein to tow a person or object while engaging in a sports activity. The person who is doing the towing may attached the connecting strap to his or her body (e.g., around the waist) or to a bicycle or other article of sports equipment being used by the person towing. The other end of the connecting strap is attached to the person or item to be towed.

DETAILED DESCRIPTION

Figure 1:
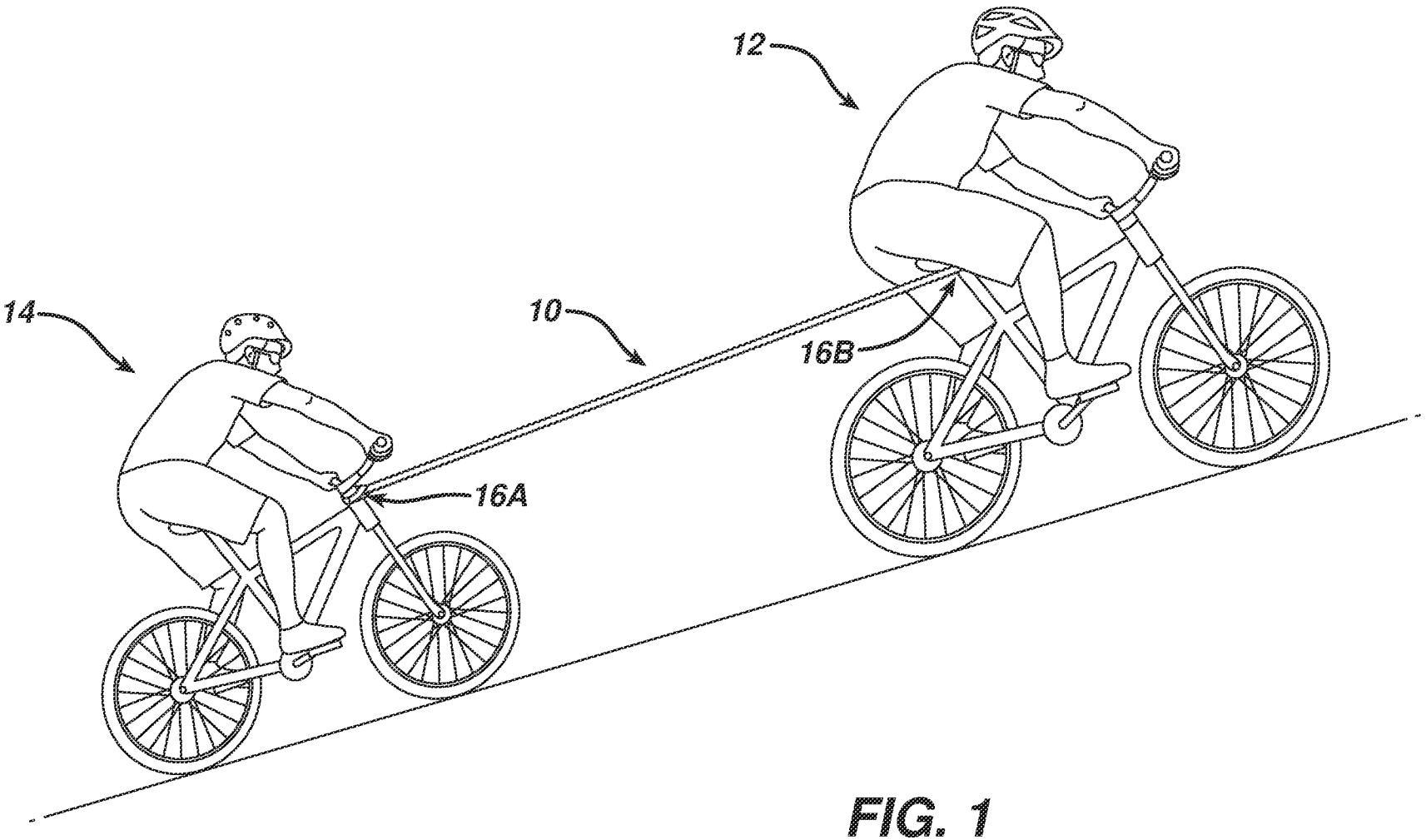
FIG. 1 is a perspective view of a pair of users using a connecting strap according to one implementation while bicycling.

Referring to FIG. 1, a connecting strap 10 is used to allow a pair of users 12, 14 of different abilities to bicycle together. This is but one example of a possible use of the connecting strap 10; other uses will be discussed below. In this example, a loop 16A at a first end of the connecting strap is girth hitched around the stem of the bike of user 14, while a loop 16B at the opposite end of the connecting strap is slipped over the saddle of the bicycle of user 12 such that it is looped around the seat post of user 12. This arrangement securely attaches the connecting strap at both ends and allows quick and easy attachment and removal. It is generally preferred that loops 16A and 16B be large enough to allow this type of attachment; however, if smaller loops are provided attachment can be by other means, e.g., a locking carabiner threaded through the loop. In some implementations, the loop has a length, when flattened against a surface, of from about 3 to 6 inches.

Figure 2:
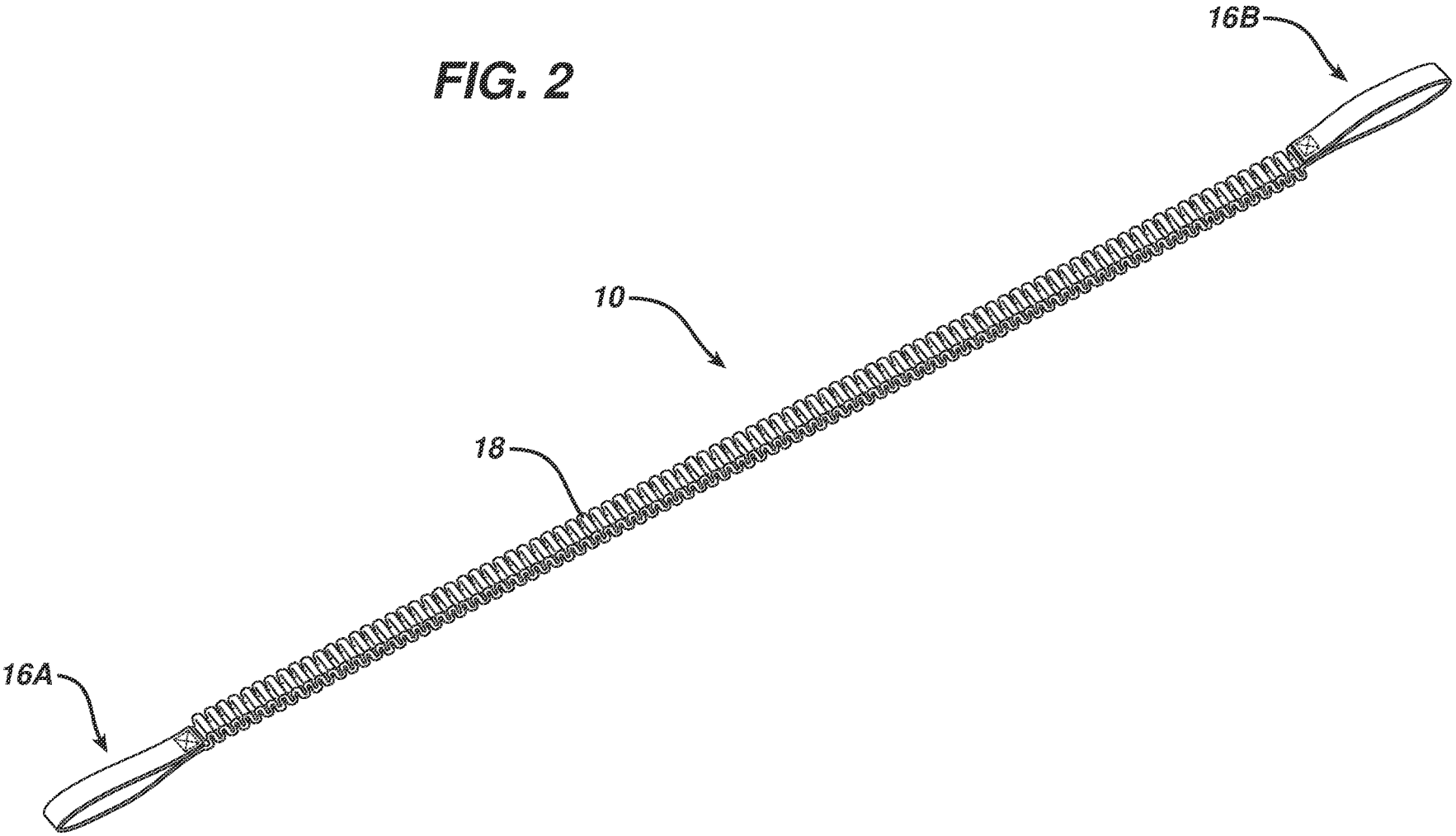
FIG. 2 is a perspective view of a connecting strap according to one implementation, in a relaxed condition.
Figure 4:
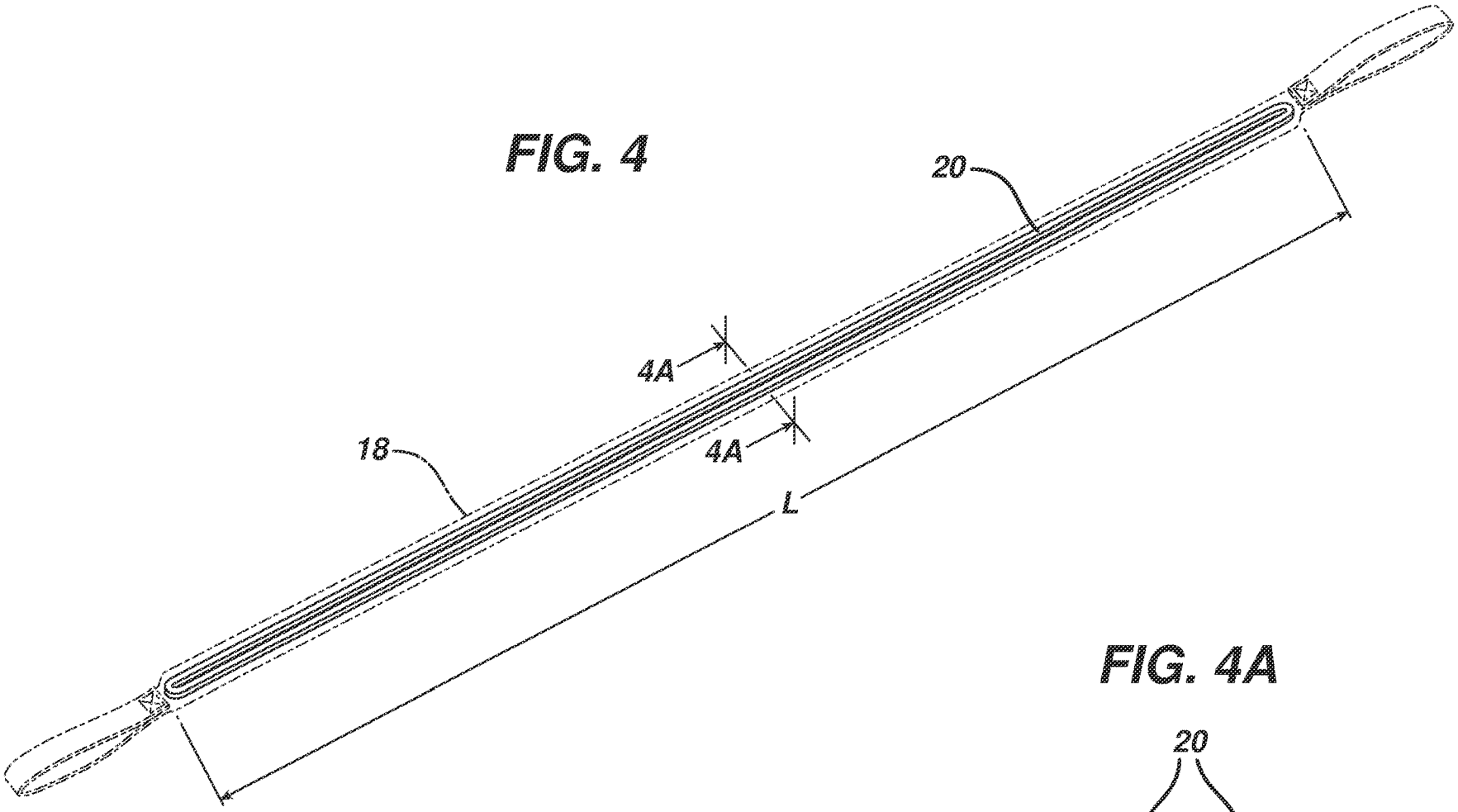
FIG. 4 is a perspective view of the band, with the webbing sleeve shown in phantom lines. The attachment straps are omitted in FIG. 4 for clarity.
Figure 5:
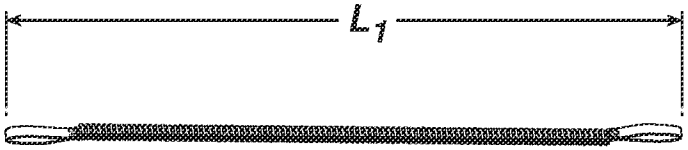
FIG. 5 is side view of the connecting strap in a fully relaxed (unstretched) condition.
Figure 6:
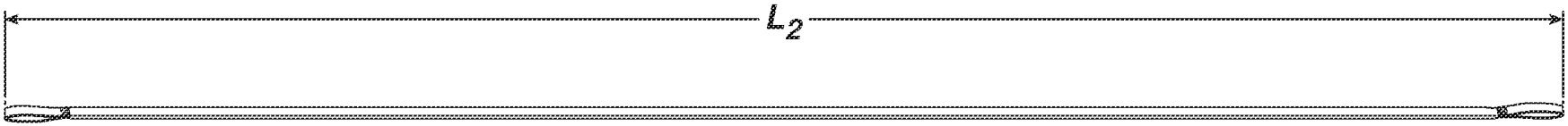
FIG. 6 is a side view of the connecting strap in a fully extended (stretched) condition, in which the webbing prevents over-stretching of the band.

Referring now to FIG. 2 and FIGS. 5-6, the connecting strap 10 includes an outer sleeve 18 of webbing material which may be formed, for example, of woven polypropylene or Nylon. As shown in FIG. 4, a continuous band of elastic material 20 is disposed within the sleeve 18.

The webbing material itself is substantially inextensible, but the sleeve is bunched up relative to the inner elastic band 20 during manufacture so that the sleeve can be extended to a much greater length by pulling on the opposite loops. For example, the ratio between the length $L_1$ of the sleeve in the fully relaxed (bunched up) state (FIG. 5) and the length $L_2$ in the fully extended state (FIG. 6) may be from about 1:3 to 1:4 (a stretch ratio of 3:1 to 4:1). The use of webbing in this bunched up arrangement around an elastic core is well known in the dog leash art. $L_1$ may be, for example, about 45 to 65 inches, and $L_2$ may be from about 160 to 200 inches.

The inner band 20 is formed of a natural or synthetic rubber material that has greater extensibility than the sleeve. The band may have a length $L_1$ in its unstretched condition of from about 40 to 50 inches ($L_1$ being the length of the loop measured as shown in FIG. 4, not the total length of the material forming the loop.) At full extension the band may have a length $L_2$ of about 160 to 200 inches. Thus, for example, the elasticity of the band may be such that the band could, if not inhibited by the sleeve, stretch to at least 4 times its relaxed length, i.e., have a stretch ratio of at least 4:1. In some implementations, the band can stretch to 6 or more times its relaxed length, e.g., the band may have a stretch ratio of greater than 6:1 or even 7:1 or more. Because the band is not fully stretched when further stretching is stopped by full extension of the sleeve 18 there is a safety factor to prevent inadvertent breaking of the band during use. It is preferred for many applications that the webbing forming the sleeve have a tensile strength of at least 1000 lbs., preferably at least 1500 lbs.

The band is preferably configured such that it pulls no more than 18 pounds, and in some implementations, no more than 15 pounds (for example, between 13 and 18 pounds) at the point at which it is fully extended to length $L_2$ (at which point the webbing sleeve takes any additional load.)

Figure 4A:
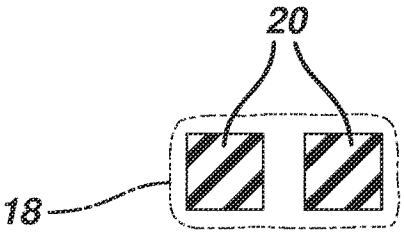
FIG. 4A is a cross-sectional view of the band taken along line 4A-4A in FIG. 4

As shown in FIG. 4A, the band 20 has a square cross-section, and is solid rather than hollow. However, other cross-sectional shapes can be used, as well as hollow tubing. It is preferred, however, that the band be a continuous loop, as shown, rather than a length of material the ends of which are glued or tied together. The use of a continuous band contributes to the strength and durability of the connecting strap.

Figure 3:
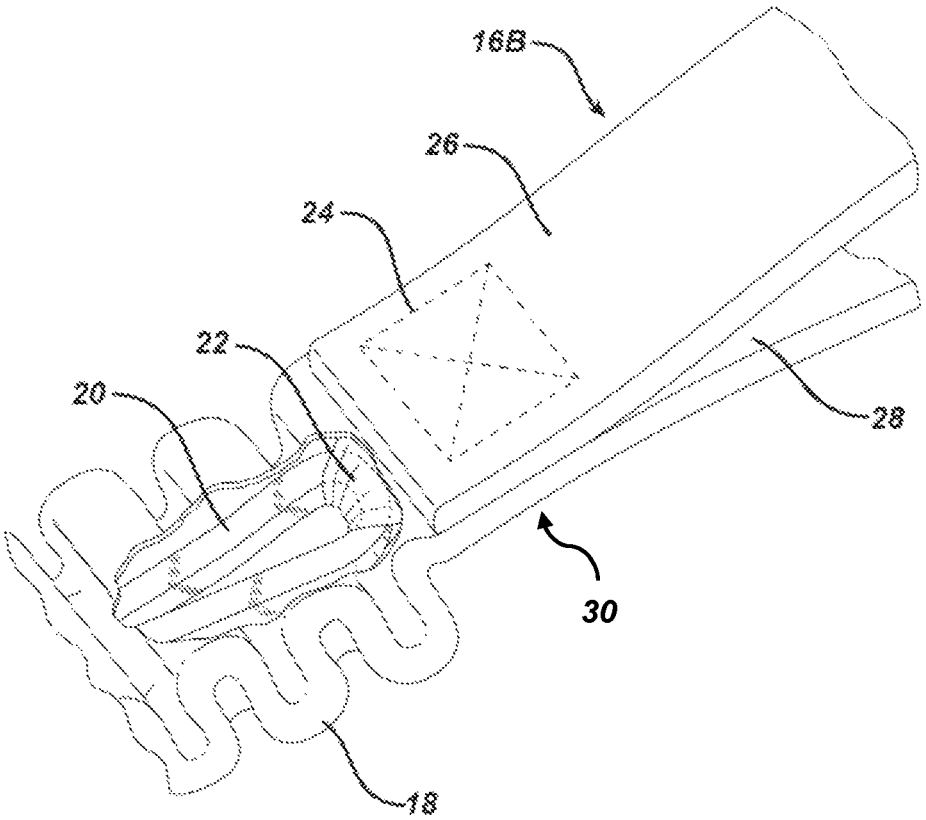
FIG. 3 is an enlarged, partially cut-away perspective view showing the connection between the band, attachment strap and webbing sleeve.

The band is secured within the sleeve at two attachment points, corresponding to the locations of the bases of the two loops 16A, 16B. Referring to FIG. 3, an attachment strap 22 is looped around the band 20 and is secured in place by stitching (bar tack 24) that extends through the free end 26 and standing end 28 of the webbing at the base 30 of the loop 16B. The attachment strap is formed of a material selected to not cut through or abrade the material of the band under normal conditions of use. For example, one suitable material is woven polyester.

The width of the strap is selected to be sufficient to allow a secure attachment via the bar tack, without being so wide that it cannot be threaded through the loop of the band within the sleeve, while the length is selected to allow both ends to be securely stitched through by the bar tack.

Advantageously, the connecting straps described herein have features that provide enhanced safety. For example, the straps tend to smoothly elongate under tension, rather than jerking the user who is being towed. In this regard, it is generally preferred that the webbing sleeve have a small amount of elasticity in order to smooth the transition when the webbing sleeve takes the load at full elongation of the band.

Moreover, due to the protection provided by the sleeve and the robust nature of the band, the connecting strap can be subjected to relatively high forces, and suddenly applied forces, without danger of the inner band failing.

Uses

The connecting strap can be used in a wide variety of applications, in addition to the cycling application discussed above. For example, the two users may be on skis, paddle-boards, skates, e-bikes, or other types of sports equipment, or the users can be running, hiking or walking. Rather than assisting with uphill or flat travel, the connecting strap can be used to provide braking during downhill travel, in which case the stronger user would be behind the weaker. The connecting strap can also be used as a dog leash, or when skijoring or bike-joring. In addition, the connecting strap can be used to pull an inanimate object when it is desired to not have a jerky connection, for example when skiing with a sled or pulk.

Other Embodiments

In other embodiments, the band may have a rectangular cross-section, or a non-polygonal cross-section, e.g., round or oval.

In some cases, one or both of the loops may be longer, or of adjustable length, or may include a hook to allow the loop to be unfastened for positioning around a user's waist or a large object.

Accordingly, other embodiments are within the scope of the following claims.

What is claimed is:

1. A connecting strap comprising:

a webbing sleeve having a first end and a second end and having a loop at each of the first and second ends, each of the loops having a base and a free end;

a band of elastic material disposed within the webbing sleeve and extending in a continuous loop, the band of elastic material having a greater extensibility than the webbing sleeve; and a pair of attachment straps distinct from the loops, each attachment strap of the pair of attachment straps being disposed adjacent a respective loop of the loops, looped through the band of elastic material, and configured to secure a portion of the band of elastic material to the webbing sleeve at the base of the respective loop by stitching the respective attachment strap to the webbing sleeve.

2. The connecting strap of claim 1 wherein the webbing sleeve is configured for a maximum elongation of from 3:1 to 4:1.

3. The connecting strap of claim 2 wherein the band of elastic material is configured to have a stretch ratio of at least 4:1.

4. The connecting strap of claim 3 wherein the band of elastic material is configured such that it pulls no more than 18 pounds at its maximum elongation.

5. The connecting strap of claim 4 wherein the band of elastic material is configured such that it pulls no more than 15 pounds at its maximum elongation.

6. The connecting strap of claim 4 wherein the webbing sleeve is configured to take any additional load once the band of elastic material reaches maximum elongation.

7. The connecting strap of claim 3 wherein the band of elastic material is configured to have a stretch ratio of at least 7:1.

8. The connecting strap of claim 3 wherein the band of elastic material has a length in a range of 40 to 50 inches when in a fully relaxed condition.

9. The connecting strap of claim 1 wherein the webbing sleeve is formed of an inextensible material.

10. The connecting strap of claim 9 wherein the inextensible material of the webbing sleeve is a woven polypropylene.

11. The connecting strap of claim 9 wherein the inextensible material of the webbing sleeve has a tensile strength of at least 1000 pounds.

12. The connecting strap of claim 1 wherein each of the loops is formed by doubling a free end of the webbing sleeve back and securing the free end in place with the stitching that secures the respective attachment strap to the webbing sleeve, thereby forming the base of the loop.

13. The connecting strap of claim 1 wherein the band of elastic material is made of a natural or synthetic rubber material.

14. The connecting strap of claim 1 wherein the band of elastic material is solid.

15. The connecting strap of claim 1 wherein, in a relaxed state, the webbing sleeve has a first length and is bunched up relative to the band of elastic material such that the webbing sleeve is configured to be extended to a second length in an extended state, the second length being longer than the first length.

16. A connecting strap comprising:

a webbing sleeve having a first end and a second end and having a loop at each of the first and second ends, each of the loops having a base and a free end;

a band of elastic material disposed within the webbing sleeve and extending in a continuous loop, the band of elastic material having a greater extensibility than the webbing sleeve; and a pair of attachment straps, each attachment strap of the pair of attachment straps being disposed adjacent a respective loop of the loops and secured to the respective loop with stitching, each attachment strap of the pair of attachment straps being configured to secure a portion of the band of elastic material to the webbing sleeve at the base of the respective loop;

wherein each of the loops is formed by doubling a free end of the webbing sleeve back and securing the free end in place with the stitching that secures the respective attachment strap to the webbing sleeve, thereby forming the base of the loop.

17. The connecting strap of claim 16 wherein, in a relaxed state, the webbing sleeve has a first length and is bunched up relative to the band of elastic material such that the webbing sleeve is configured to be extended to a second length in an extended state, the second length being longer than the first length.

18. The connecting strap of claim 16 wherein the webbing sleeve is made of a woven polypropylene.

19. The connecting strap of claim 16 wherein the webbing sleeve is configured for a maximum elongation of from 3:1 to 4:1, and wherein the band of elastic material is configured to have a stretch ratio of at least 4:1.

* * * * *